US006783123B2

(12) United States Patent
Guimont et al.

(10) Patent No.: US 6,783,123 B2
(45) Date of Patent: Aug. 31, 2004

(54) ADJUSTABLE VISE JAW ASSEMBLY

(75) Inventors: Thomas R. Guimont, Lemont, IL (US); Gus Romas, Orland Park, IL (US)

(73) Assignee: Easy-Set Corporation, Lemont, IL (US)

( * ) Notice: Subject to any disclaimer, the term of this patent is extended or adjusted under 35 U.S.C. 154(b) by 0 days.

(21) Appl. No.: 09/757,725

(22) Filed: Jan. 10, 2001

(65) Prior Publication Data

US 2002/0089109 A1 Jul. 11, 2002

(51) Int. Cl.[7] ..... B25B 1/24

(52) U.S. Cl. ..... 269/226; 269/282; 269/283; 269/296; 269/299

(58) Field of Search ..... 269/266, 20, 267, 269/279–284, 26, 25, 296, 299

(56) References Cited

U.S. PATENT DOCUMENTS

| | | | | |
|---|---|---|---|---|
| 1,453,176 A | * | 4/1923 | Perrine | 269/266 |
| 2,882,771 A | * | 4/1959 | Blazek | 269/266 |
| 4,558,856 A | | 12/1985 | Shaffer | |
| 4,602,772 A | | 7/1986 | Wight et al. | |
| 4,706,949 A | | 11/1987 | Dossey et al. | |
| 4,960,270 A | | 10/1990 | Fitzpatrick | |
| 6,345,816 B1 | * | 2/2002 | Fitzpatrick | 269/266 |

OTHER PUBLICATIONS

Kurt Anglock Vise Data Sheet (1 pg).
Kurt II 2nd Generation Precision Machine Vises—VersaLock and DoubleLock Data Sheet (1 pg).

* cited by examiner

*Primary Examiner*—Robert C. Watson
(74) *Attorney, Agent, or Firm*—Wallenstein Wagner & Rockey Ltd.

(57) ABSTRACT

A vise jaw assembly for supporting and securing an object to be worked upon in a vise is provided. The jaw assembly 10 has a block 14 with a plurality of apertures 16, a plurality of channels 40 passing through a portion of the block 14, a plurality of inlet holes 44, and a plurality of pins 48. Each pin 48 is located within an aperture 16 and is in slidable engagement with the aperture 16. The channels 40 can extend in a generally longitudinal direction of the block 14. Each channel has a first segment 42 in fluid communication with an inlet hole 44 and a second segment 45 in fluid communication with at least one aperture 16. At least one fluid passageway 46 extends from an inlet hole 44 to at least one aperture 16. Each pin 48 is independently deployable to a use position P1 and retractable to a non-use position P2. A plate 18 is secured to the rear surface 32 of the block 14 to enclose the channels 40. The assembly 10 further includes a means for securing 34 the plate 18 to the block 14 and a means for fixedly attaching 36 the block 14 and plate 18 to the vise 12.

49 Claims, 5 Drawing Sheets

ADJUSTABLE VISE JAW ASSEMBLY

DESCRIPTION

1. Technical Field

This invention relates generally to a device for use in a vise and more particularly concerns an adjustable jaw assembly for supporting and securing an object to be worked upon in a vise.

2. Background of the Invention

This invention relates to an adjustable jaw assembly for use in a vise to support and secure an object to be worked upon. Generally, the vise includes a fixed member, a moveable member, a base, a deck, and a lever to displace the moveable member. The fixed and moveable members are spaced a distance apart and are located above the deck. A jaw is affixed to each of the members, and the jaws secure the object when the moveable member is displaced a distance sufficient to engage the object. Once the object is secured by the jaws, the object can be worked upon in a number of ways, including being drilled, finished, bored, or milled.

Jaws can be fabricated from a number of materials, and the materials can vary with the type of objects used in the vise. For example, in vises designed to hold metallic objects, the jaws are often hardened, tool-grade steel with complex surfaces or serrations that grip the object to prevent damage to soft parts. Vises can be permanently installed to a work surface such as a table, or can be adapted for portable use. In addition, vises can be integrated into a machine or a production process.

With most conventional vises, an operator secures an object resting on the vise deck by using the lever to displace the moveable member and jaw a distance such that both jaws engage the object. In addition, some conventional vises can support and secure an object a distance above the vise deck by utilizing a combination of jaws and parallels. A parallel is a rigid element, usually metallic, that is secured to each of the jaws. Typically, a set of parallels are used in conjunction with the jaws; however, only one pair of parallels can be installed in a vise at a time. Each of the parallels have a step, which supports the object a distance above the deck. The step is a fixed structure on the parallel and cannot be adjusted to accommodate any variations in either the object, the tooling, or the parallels. The set of parallels consists of numerous pairs of parallels, each pair of parallels having different step heights. The position of the step determines the height at which the object is supported. To vary the height at which the object is supported, an entirely different parallel must be selected and secured to each of the jaws.

In a typical machine shop, there are a multitude of objects used in connection with a vise, each of the objects having different dimensions and configurations. To properly support and secure each of these objects requires an immense set of parallels, which consumes considerable work and/or storage space. In addition to consuming valuable work and storage space, the space available for other equipment is reduced by the sheer size of the set of parallels.

The process of removing and installing different parallels is extremely time consuming in both labor and production costs, especially when measured over the course of a work shift. When different parallels are required, the parallels already installed in the vise must be removed from the jaws to which they are secured. This usually requires the removal of multiple fasteners from the parallels and the jaws. Once the fasteners and the parallels are removed, the appropriate replacement parallels must be selected from the set of parallels. Next, the replacement parallels are placed in close proximity to the jaws and the fasteners are then inserted through the parallels and the jaws to secure the parallels to the jaws. While different parallels are being selected and installed in the vise, no objects can be placed in the vise. As a result, the vise remains idle and the productivity of the vise is reduced. This time consuming process is repeated many times over the course of a work shift when different objects with different configurations and dimensions are placed in the vise, or when the height at which the object is supported above the deck is varied.

In addition to being extremely time consuming, the multi-step process of removing and installing different parallels reduces the productivity and efficiency of both the operator and the vise. Also, because the set of parallels must be expansive enough to accommodate different objects, the equipment costs are increased.

Consequently, there is a definite need for a vise jaw assembly capable of both supporting and securing an object in an elevated position, while remedying the problems and shortcomings identified above.

SUMMARY OF THE INVENTION

The present invention relates to a vise jaw assembly for supporting and securing and object to be worked upon in a vise. The jaw assembly includes a block, a plurality of apertures in the block, a plurality of pins, and a plate. The vise includes a stationary member, moveable member, a base, a deck, and a lever to displace the moveable member towards the stationary member. Typically, two jaw assemblies are installed in the vise, one on each member.

Once installed in the vise, the jaw assembly can be used: (i) to secure an object resting on the deck surface; (ii) to secure and support an object in an elevated position; and, (iii) to secure and support an object in an elevated and angled position. Unlike conventional parallels, the jaw assembly is multi-adjustable and does not require separate pieces to support and secure objects with different shapes and dimensions. Consequently, the productivity and efficiency of both the operator and the vise are dramatically increased.

According to one aspect of the invention, the block has a plurality of apertures, where each aperture forms a passageway from the front surface of the block to the rear surface of the block. The apertures can be loosely grouped or positioned in a horizontal row arrangement. The apertures and the resulting aperture rows are located at various distances from the lower edge of the block.

According to another aspect of the invention, a plurality of channels are located in a portion of the block, preferably in the rear surface of the block. Each channel has a first segment in fluid connection with an inlet hole, meaning that a fluid can move from the inlet hole through the first segment and into the channel. Each channel has a second segment in fluid communication with at least one of the apertures, meaning that a fluid can move from through the second segment and into at least one aperture. The channels can extend in a generally longitudinal direction of the block, although other channel configurations are possible. The plate is secured to the rear surface of the block to enclose the channels. The plate seals the channels to ensure movement of the fluid from the inlet holes through the channels.

According to another aspect of the invention, the block has at least one fluid passageway. The fluid passageway extends from the inlet hole to at least one aperture. The fluid passageway permits a fluid to move from the inlet hole through the channel to the aperture(s). Preferably, a plurality of apertures intersect the same channel. Thus, the fluid can move from the inlet hole through the channel to the multiple apertures. Because the block has multiple apertures, channels, and inlet holes, multiple fluid passageways are formed in the block.

According to another aspect of the invention, the block has a means for securing the plate to the block and a means for fixedly attaching the plate and block to the vise. Both the channels and the apertures accommodate the securing means and the attaching means by being located about each of the means. As a result, the channels and the apertures avoid interfering with the operation of the means.

According to another aspect of the invention, the block includes a plurality of pins, where each pin is located within an aperture. Each pin is in slidable engagement with the aperture in which it is located. Because each pin is in slidable engagement with its respective aperture, each pin is independently deployable to a use position and retractable to a non-use position. As a result of being independently deployable, the movement of one pin does not depend upon or affect the movement of another pin. The jaw assembly utilizes a pin or a plurality of pins to support an object to be worked upon in the vise.

According to a further aspect of the invention, when deployed to the use position, a portion of the pin extends beyond the block and forms a support structure to support the object. Since each pin is independently deployable and retractable, the support structure formed by the deployed pins can have numerous configurations and arrangements. In the non-use position, the pins are not capable of supporting an object in the vise. Instead, the jaw assembly can secure an object resting on the vise deck by engaging and clamping the object as the moveable member is displaced towards the fixed member.

According to another aspect of the invention, each pin has a first pin portion and a second pin portion. Each aperture has a first aperture portion and second aperture portion, and a ledge is formed between the first and second aperture portions. During movement or deployment of the pin to the use position, the ledge prevents movement of the second pin portion into the first hole portion by engaging the second pin portion. Thus, the ledge obstructs or precludes further movement of the pin past the use position.

Other features and advantages of the invention will be apparent from the following specification taken in conjunction with the following drawings.

DETAILED DESCRIPTION OF THE INVENTION

Figure 1:
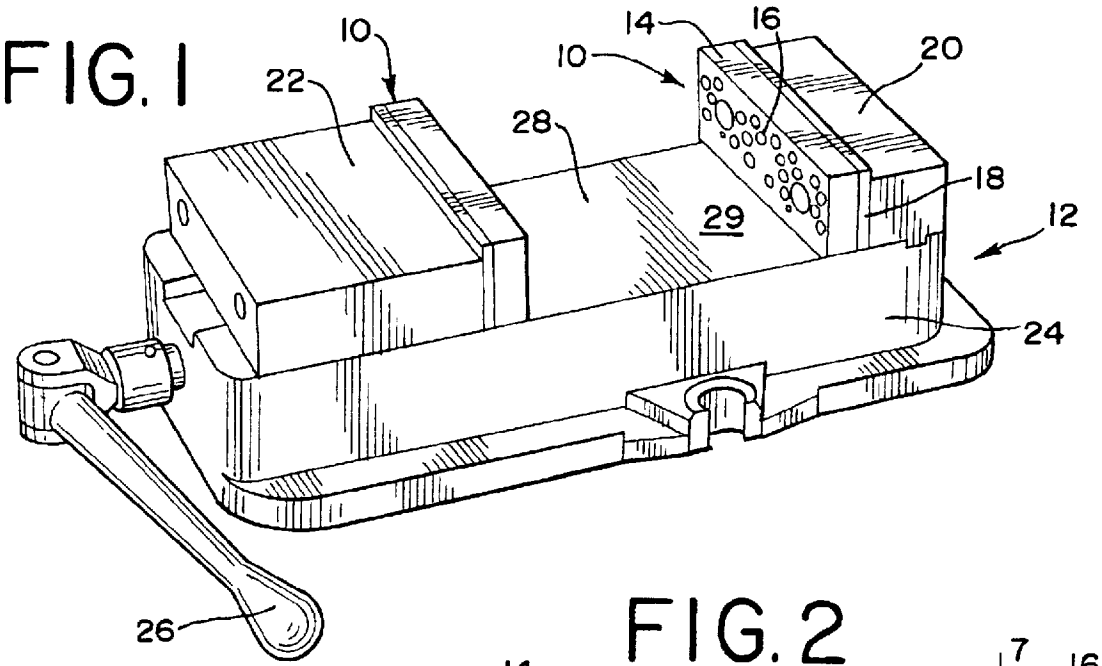
FIG. 1 is a perspective view of an embodiment of a jaw assembly of the present invention installed in a vise.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Referring to the drawings, FIG. 1 shows a jaw assembly of the present invention generally designated by the reference numeral 10. The jaw assembly 10 generally includes a block 14, a plurality of apertures 16, and a plate 18. The jaw assembly 10 is installed in a vise 12, which consists of a stationary vise member 20, a moveable vise member 22, a vise base 24, and a lever 26 to displace the moveable vise member 22. Typically, two jaw assemblies 10 are installed in the vise 12, with a separate jaw assembly 10 affixed to each of the stationary member 20 and the moveable member 22. However, a single jaw assembly 10 can be used in the vise 12. The lever 26 is rotated to displace the moveable member 22 towards the stationary member 20.

The vise base 24 has a deck 28, which represents the upper portion of the base 24. The deck 28 has a deck surface 29 and the surface area of the deck 28 is reduced when the moveable member 22 is displaced towards the fixed member 20. When the jaw assembly 10 is installed in the vise 12, the lower edge 38 of the block 14 is adjacent or juxtaposed above the deck surface 29. The structure of the jaw assembly 10 will first be described and then the operation of the jaw assembly 10 will be described.

Structure of the Jaw Assembly

Figure 2:
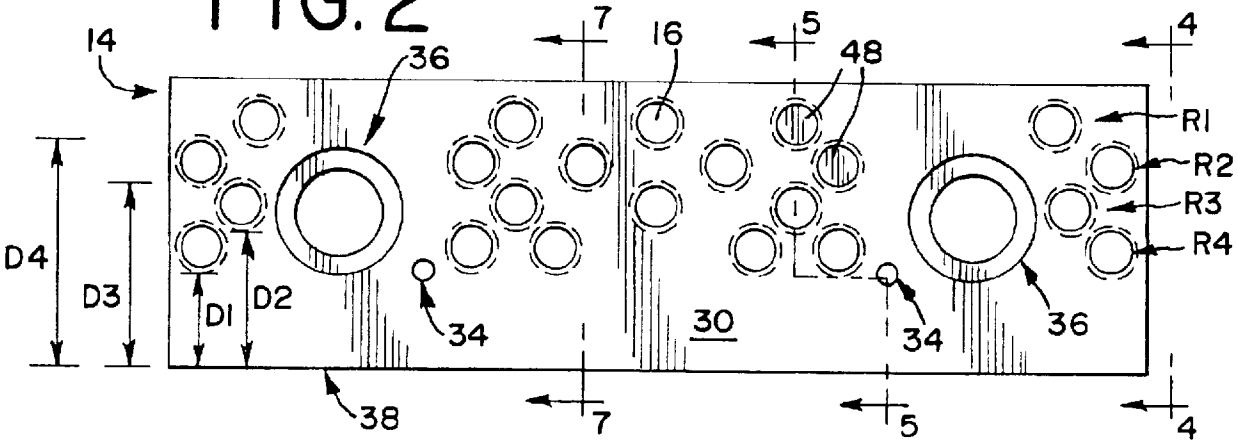
FIG. 2 is a plan view of a front surface of a block of the jaw assembly of FIG. 1 showing a plurality of apertures.
Figure 3:
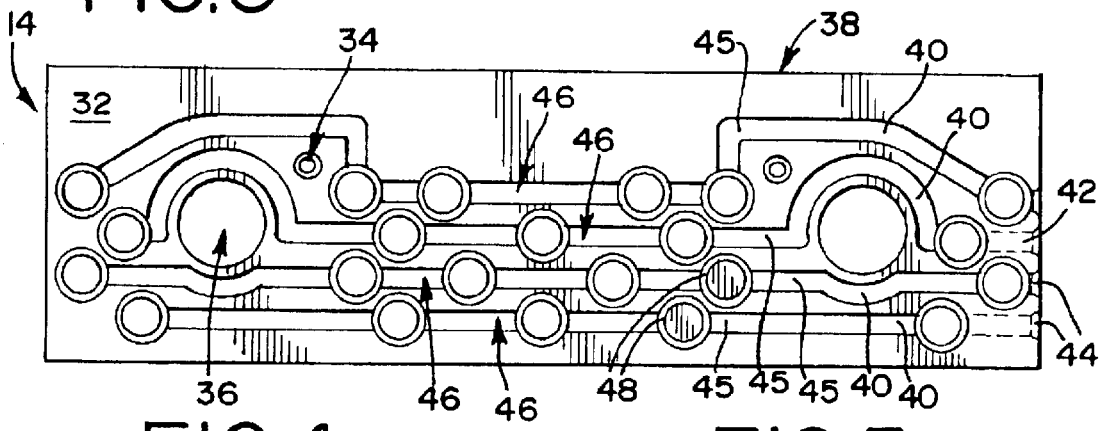
FIG. 3 is a plan view of a rear surface of the block of the jaw assembly of FIG. 1 showing a plurality of apertures and a plurality of channels.

As shown in FIGS. 1–3, the block 14 has a plurality of apertures 16, where each aperture 16 forms a passageway from the front surface 30 of the block 14 to the rear surface 32 of the block. The apertures 16 can be loosely grouped or positioned in a horizontal row arrangement. As shown in FIGS. 2 and 3, there are four rows of apertures, R1–R4; however, the arrangement and configuration of apertures 16 can vary depending upon a number of factors, including but not limited to the number and size of the apertures 16, and the dimensions of the block 14. The apertures 16 and the resulting aperture rows R1–R4 are located at various distances, D1–D4, from the lower edge 38 of the block 14. When the jaw assembly 10 is installed in the vise 12, the lower edge 38 of the block 14 is juxtaposed above the deck 28.

Figure 4:
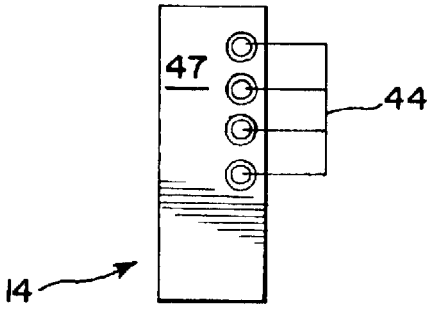
FIG. 4 is an end view of the block of FIG. 1 showing a plurality of inlet holes.

Referring to FIGS. 3 and 4, a plurality of channels 40 are located in a portion of the block 14, preferably the rear surface 32 of the block 14. Each of the channels 40 has an first segment 42 in fluid connection with an inlet hole 44, meaning that a fluid can move from the inlet hole 44 through the first segment 42 and into the channel 40. The inlet holes 44 are adapted to receive the fluid, for example water or compressed air, and the holes 44 can have a number of configurations to facilitate the reception of the fluid. Preferably, the inlet holes 44 are positioned at an exterior end surface 47 of the block 14. Each of the channels 40 has a second segment 45 in fluid connection with at least one of the apertures 48, meaning that fluid can move through the second segment 45 and into at least one aperture 48. Preferably, a plurality of apertures 48 intersect the same channel 40. The channels 40 can extend in a generally longitudinal direction of the block 14, although other channel 40 configurations are possible.

The block 14 has at least one fluid passageway 46 which extends from an inlet hole 44 to at least one aperture 48. The fluid passageway 46 permits a fluid to move from the inlet hole 44 through the channel 40 (including the first segment 42 and the second segment 45) to an aperture 16. Preferably, a plurality of apertures 16 intersect the same channel 40 to define the fluid passageway 46. Accordingly, the fluid can move from the inlet hole 44 through the channel 40 to multiple apertures 16. Because the block 14 has multiple apertures 16, channels 40, and inlet holes 44, multiple fluid passageways 46 are formed in the block 14. As shown in FIG. 3, there are four channels 40 and four resulting fluid passageways; however, the number of channels and fluid passageways can vary depending upon a number of factors, including but not limited to the size and configuration of the channels 40, the size and configuration of the apertures 16, and the dimensions of the block 14.

The plate 18 is secured to the rear surface 32 of the block 14 to enclose or seal the channels 40 and the fluid passageways 48. The plate 18 ensures movement of the fluid from the inlet holes 44 through the channels 40 to the apertures 16, or through the fluid passageway 48. To properly seal the channels 40 and ensure the integrity of the fluid passageways 46, the interface area (not shown) between the plate 18 and the block 14 should be equivalent. The interface area is defined as the area where the plate 18 and the block 14 meet when the plate 18 is secured to the block 14. To reduce the material costs of the jaw assembly 10, the thickness of the plate 18 can be less than the thickness of the block 14. The surface (not shown) of the plate 18 that interfaces with the rear surface 32 of the block 14 can be machined to a smooth, or semi-smooth finish to ensure the adequate sealing of the channels 40 and the fluid passageways 46.

The block 14 has a means for securing 34 the plate 18 to the block 14 and a means for fixedly attaching 36 the plate 18 and block 14 to the vise 12. The securing means 34 can consist of a tapped hole in the block 14, a corresponding hole (not shown) in the plate 18, and a fastening screw. Alternatively, the tapped hole can be in the plate 18 and the corresponding hole can be in the block 14. The attaching means 36 can consist of a bolt hole 36 in the block 14, a corresponding hole in the plate, and a fastening bolt or fastening cap screw. Both the channels 40 and the apertures 16 accommodate the securing means 34 and the attaching means 36 by being located about each of the means 34, 36. As a result, the channels 40 and the apertures 16 avoid interfering with the operation of the means 34, 36.

In another embodiment, the channels 40 are located in an interior portion of the block 14. As a result, the plate 18 can be removed from the jaw assembly 10 and the securing means 34 can be used to secure the block 14 directly to one of the vise members 20, 22. The channels 40 can be bored or machined into the block 40 to create internal fluid passageways 46. In this configuration, the members 20, 22 are adapted to receive the block 14.

In yet another embodiment, the channels are located in the rear surface 32 of the block 14 but the plate 18 is removed from the jaw assembly 10. In this configuration, the members 20, 22 are adapted to directly receive the block 14 and seal the channels 40. To seal the channels 40 and ensure the integrity of the fluid passageways, the interface area (not shown) between the members 20, 22 and the block 14 should be equivalent. The interface area is defined as the area where the plate 18 and the members 20, 22 meet when the plate 18 is secured to one of the members 20, 22. The surface (not shown) of the members 20, 22 that interfaces with the rear surface 32 of the block 14 can be machined to a smooth, or semi-smooth finish to ensure the adequate sealing of the channels 40 and the fluid passageways. Also, the members 20, 22 should have dimensions equivalent to the block 14 to seal the channels 40 and ensure the integrity of the fluid passageways. This configuration reduces material costs by eliminating a component, the plate 18, from the jaw assembly.

Figure 5:
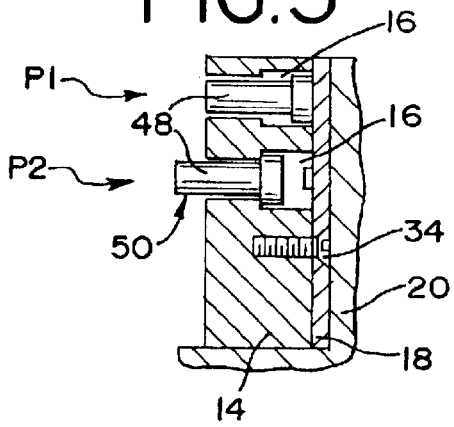
FIG. 5 is a partial cross-sectional view of the block of FIG. 1 taken along line 5—5 of FIG. 2 showing a pin in a use position and a pin in a non-use position.

Referring to FIGS. 2 and 5, the jaw assembly 10 further includes a plurality of pins 48, where each pin 48 is located within an aperture 16. Since each pin 48 is positioned within an aperture 16, the pins 48 are loosely grouped or positioned in a horizontal row arrangement, R1–R4 at various distances D1–D4 from the lower edge 38 of the block 14. Each pin 48 is in slidable engagement with the particular aperture 16 in which it is located. Stated differently, each pin 48 is received by a distinct aperture 16 and that aperture 16 allows for movement of that pin 48. Because each pin 48 is in slidable engagement with its respective aperture 16, each pin 48 is independently deployable to a use position and retractable to a non-use position. As a result of being independently deployable, the movement of one pin does not depend upon or affect the movement of another pin. The non-use position, P1, is defined by the pin 48*a* remaining within the aperture 16. In the non-use position P1, the pin 48*a* remains un-deployed. The use position, P2, is defined by the pin 48*b* extending substantially perpendicular to the front surface 30 of the block 14. In the use position P2, a deployed portion 50 of the pin 48 extends beyond the block 14. To retract a pin 48 to the non-use position P1, a small amount of force can be applied to the portion 50 of the pin 48 and directed inward toward the block 14.

The jaw assembly 10 utilizes a pin 48 or a plurality of pins 48 to support an object to be worked upon in the vise 12. When deployed to the use position P2, the portion 50 of the pin 48 extends beyond the block 14 and forms a support structure to support the object. Since each pin 48 is independently deployable and retractable, the support structure formed by the deployed pins 48 can have numerous configurations and arrangements. For example, pins 48 from the same row can be combined to support the object, or pins 48 from different rows can be combined to support the object. When deployed to the use position P2, the pins 48 are able to support objects with a wide variety of shapes and configurations, including but not limited to those that are cylindrical, square, and rectangular.

In the non-use position P1, the pins 48 are not capable of supporting an object in the vise 12. Instead, the jaw assembly 10 can secure an object resting on the vise deck 28 by engaging and clamping the object as the moveable member 22 is displaced towards the fixed member 20.

Figure 6:
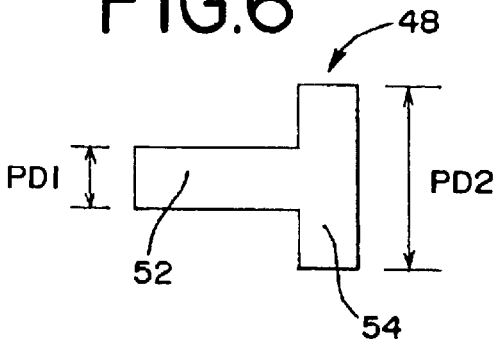
FIG. 6 is a plan view of the pin of FIG. 5.
Figure 7:
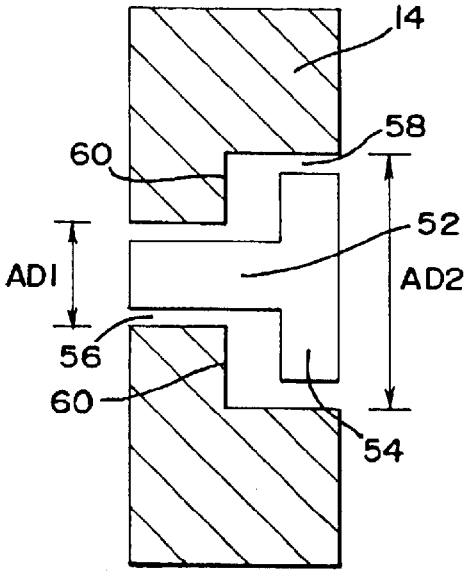
FIG. 7 is a partial cross-sectional view of the block of FIG. 1 taken along line 7—7 of FIG. 2 showing a pin in the non-use position.

Referring to FIG. 6, each pin 48 has a first pin portion 52 and a second pin portion 54. The first pin portion 52 has a diameter, PD1, less than a diameter, PD2, of the second pin portion 54. Referring to FIG. 7, the aperture 16 has a first aperture portion 56 and second aperture portion 58, where the first aperture portion 56 has a diameter, AD1, less than a diameter, AD2, of the second aperture portion 58. As a result of the diameter AD1, AD2 differences, a ledge 60 is formed between the first and second aperture portions 56, 58. As stated above, each pin 48 is in slidable engagement with the aperture 16 in which it is located. During movement or deployment of the pin 48 to the use position P2, the ledge 60 prevents movement of the second pin portion 54 into the first hole portion 56 by engaging the second pin portion 54. Thus, the ledge 60 obstructs or precludes further movement of the pin 48 past the use position P2 when the second pin portion 54 comes into contact with or engages ledge 60. The engagement of the ledge 60 and the second pin portion 54 help to ensure the complete deployment of each pin 48 to the use position P2.

Although each pin 48 is completely deployed to the use position P2 when the ledge 60 engages the second pin portion 54, there can be a partial deployment of the pin 48 when there is a small gap between the ledge 60 and the second pin portion 54. In the partial deployment position, the pin 48 can still be used to support an object in the vise 12 because the deployed portion 50 of the pin 48 extends beyond the block 14 to form a support structure for the object.

Figure 8:
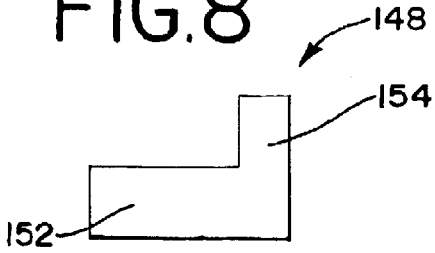
FIG. 8 is a plan view of an alternate pin of FIG. 5.

In another embodiment shown in FIG. 8, each pin 148 has a pin portion 152 and a stop 154. The stop 154 is a structure that engages the ledge 60 in an interference fit to prevent further deployment of the pin 148. Therefore, the ledge 60 precludes further movement of the pin 148 past the use position P2 when the stop 154 engages the ledge 60. The engagement of the ledge 60 and the stop 154 help to ensure the complete deployment of each pin 148 to the use position P2.

Figure 9:
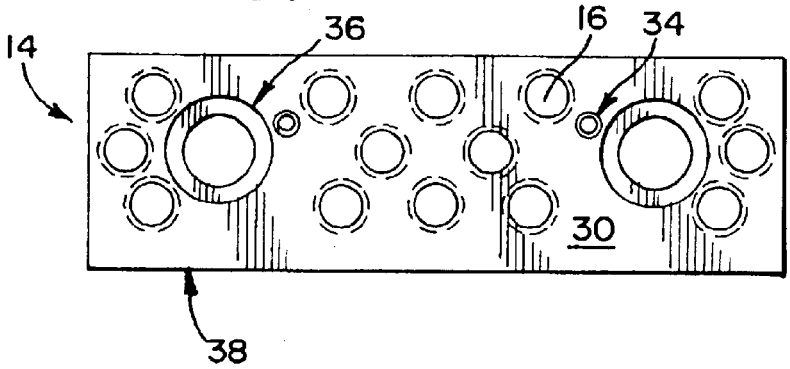
FIG. 9 is a plan view of a front surface of a block of an alternate jaw assembly of the present invention.
Figure 10:
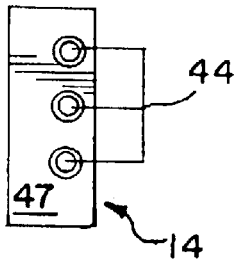
FIG. 10 is an end view of the block of FIG. 9 showing a plurality of inlet holes.
Figure 11:
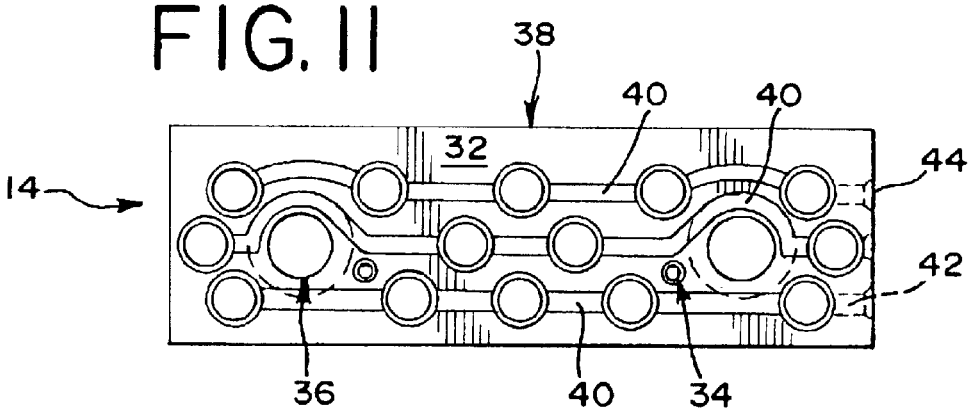
FIG. 11 is a plan view of a rear surface of the block of the jaw assembly of FIG. 9 showing a plurality of apertures and a plurality of channels.

The size of the jaw assembly 10 can vary depending upon the size of the vise 12 and the size of the object to be worked upon in the vise. For conventional vises, the size of the jaw assembly 10 can range between 4–10 inches in length. For larger vises designed to accept oversized objects or for use in larger machinery, the jaw assembly 10 can exceed 10 inches in length. In addition, the jaw assembly 10 can be oversized in comparison to the vise 12, meaning that a portion of each side of the jaw assembly 10 extends past the members 20, 22 of the vise 12. A four-inch version of the jaw assembly 10 is shown in FIGS. 9–11.

As the size of the jaw assembly 10 is varied, the number and size of the apertures 16, channels 40, the fluid passageways 46, and pins 48 can vary. However, there is no fixed relationship between the number and size of the apertures 16, channels 40, fluid passageways 46, and pins 48 when the sizes of the jaw assembly 10 is varied. For example, an eight-inch jaw assembly can have a greater number of apertures 16, channels 40, and pins 48 than a six-inch jaw assembly. Alternatively, the eight-inch jaw assembly can have the same number of apertures 16, channels 40, and pins 48 as the six-inch jaw assembly, but the size and configuration of these components can be increased in a manner consistent with the larger eight-inch jaw assembly.

The jaw assembly 10, including the block 14, the plate 18, and the pins 48, are constructed of tool grade steel. However, the jaw assembly 10 could be fabricated from other high-strength materials suitable for use in connection with a vise.

Operation of the Jaw Assembly

Although the specific installation of the jaw assembly 10 in the vise 12 is not shown, it can be readily understood from FIGS. 1–10. Generally, the attaching means 36 is used to secure the jaw assembly 10 to one of the members 20, 22. A second jaw assembly 10 can be secured to the other member 20, 22 with the attaching means 36.

Once installed in the vise 12, the jaw assembly 12 can be used: (i) to secure an object resting on the deck surface 29; (ii) to secure and support an object in an elevated position above the deck surface 29; and, (iii) to secure and support an object in an elevated and angled position above the deck surface 29.

Before the object is placed in the vise 12, the pins 48 are first configured in the non-use position P1, shown in FIG. 4. In the non-use position P1, each pin 48 remains within each aperture 16 and no pins 48 extend beyond the front surface 30 of the block 14. In the non-use position P1, the jaw assembly 10 is unable to support an object; however, the jaw assembly 10 can secure an object located on the vise deck surface 29 between members 20, 22. A jaw assembly 10 is attached to one or both of the members 20, 22 and secures the object when the moveable member 22 is displayed towards the object and the fixed member 20. After the moveable member 22 is displaced a sufficient amount, the object is engaged and secured by the front surface 30 of the blocks 14.

To support and secure an object in an elevated position above the deck surface 29 and above the lower edge 38 of the block 14, a pin 48 or an arrangement of pins 48 must be deployed from the non-use position P1 to the use position, P2. The pins 38 can be deployed to the use position P2 by applying a fluid, i.e. water or compressed air, to one or more of the inlet holes 44. As disclosed above, each aperture 16 intersects a channel 40 to define a fluid passageway 46, which permits the fluid to move from the inlet hole 44 through the channel 40 to the aperture 16. Once supplied to the inlet holes 44, the fluid is transmitted through the fluid passageways and to the apertures 16. When the fluid reaches the apertures 16, the fluid applies pressure on each of the pins 38. Once a sufficient amount of pressure is applied by the fluid, the pins 48 are deployed to the use position P2. The range of fluid pressure required to deploy the pins 48 can vary from 15 to 125 psig.

Referring to FIGS. 2–4, the fluid can be applied to one or more inlet holes 44 and as a result, one or more rows of pins 48 can be selectively deployed to the use position P2. This means that the exact row of pins 48 to be deployed can be controlled by the application of fluid to specific inlet holes 44. For example, to deploy all of the pins 48 in the first row R1, fluid should be applied to the uppermost inlet hole 44. To deploy the all of the pins 48 in the first and fourth rows R1, R4, fluid should be applied to the uppermost and lowermost inlet holes 44. To deploy all of the pins 48 in the jaw assembly 10, fluid should be applied to all of the inlet holes 44. An operator of the jaw assembly 10 can apply fluid to the inlet holes 44 sequentially, or to all inlet holes 44 at the same time depending upon the type of equipment used to supply the fluid. After the desired pins 48 are deployed to the use position P2, a regulator on the line supplying the fluid can be activated to stop the flow of the fluid. Similarly, the regulator can be used to initiate the application of the fluid to the inlet holes 44.

Once the pins 48 are deployed to the use position P2, the operator of the jaw assembly 10 can selectively retract a pin 48 or a plurality of pins 48 to form the support structure. By deploying pins 48 and then retracting a pin 48 or a plurality of pins 48, the operator can customize the support structure to match the shape and configuration of the object to be supported and secured by the jaw assembly 10. As shown in FIGS. 12–15, a number of multi-shaped objects O can be supported by an assortment of pins 48 deployed to the use position P2.

In each of FIGS. 12–15, a different support structure is formed from deployed pins 48 to support the distinct configurations and dimensions of the object O. As disclosed above, the apertures 16 and pins 48 are located at various distances D1–D4 from the lower edge 38 of the block 14. When the jaw assembly 10 is properly installed in the vise 12, the block 14 is juxtaposed above the deck 28 and deck surface 29. Accordingly, the resulting support structure supports the object O in an elevated position above the deck 28. The elevated position can also be measured relative to the lower edge 38 of the block 14.

When the object O is supported in an elevated position, a portion of the object O can extend beyond the jaw assembly 10. This can be a beneficial configuration because work can be more easily performed on the portion of the object O that extends beyond the jaw assembly 10. For example, it can be easier to grind a surface of the object O when it extends beyond the jaw assembly 10 because that surface is exposed and is more accessible.

Figure 12:
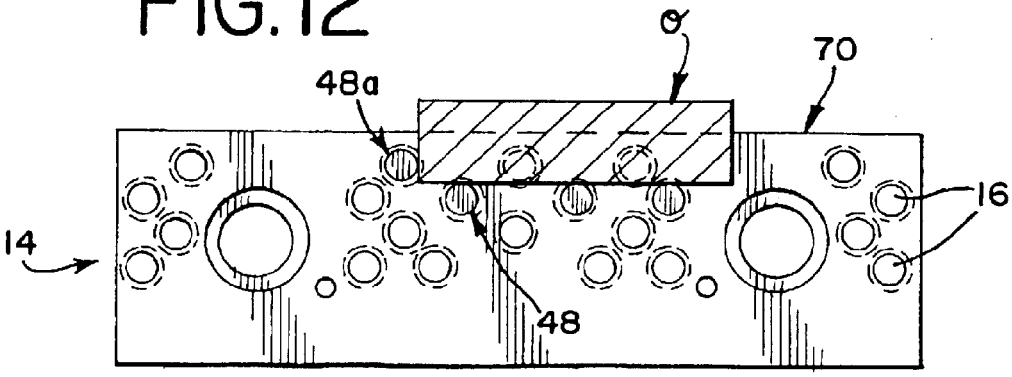
FIG. 12 is a plan view of a front surface of a block of the jaw assembly of FIG. 1 showing a rectangular object supported by a support structure formed from a plurality of pins deployed to the use-position.
Figure 13:
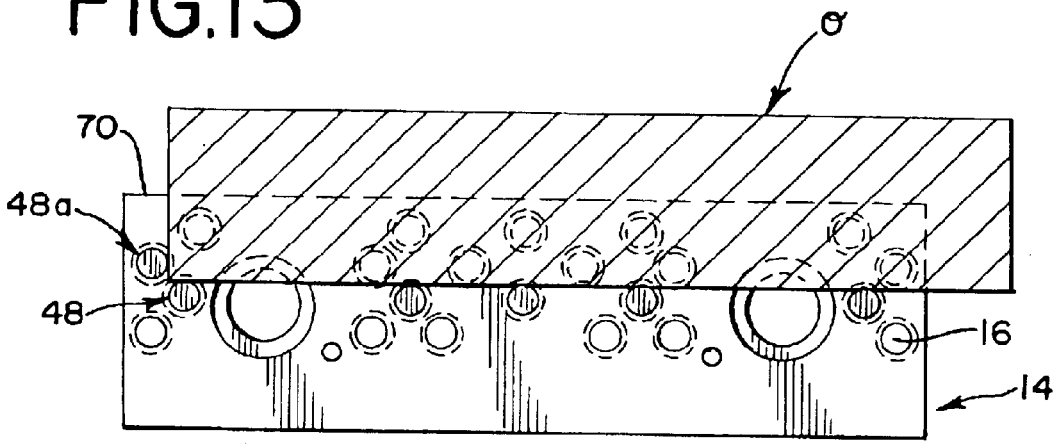
FIG. 13 is a plan view of a front surface of a block of the jaw assembly of FIG. 1 showing a rectangular object supported by a support structure formed from a plurality of pins deployed to the use-position.
Figure 14:
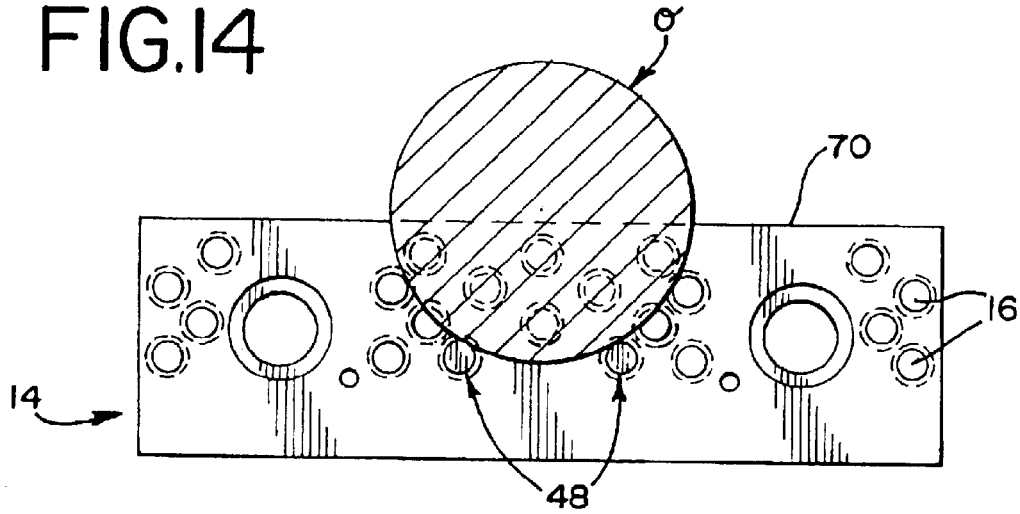
FIG. 14 is a plan view of a front surface of a block of the jaw assembly of FIG. 1 showing a circular object supported by a support structure formed from a plurality of pins deployed to the use-position.
Figure 15:
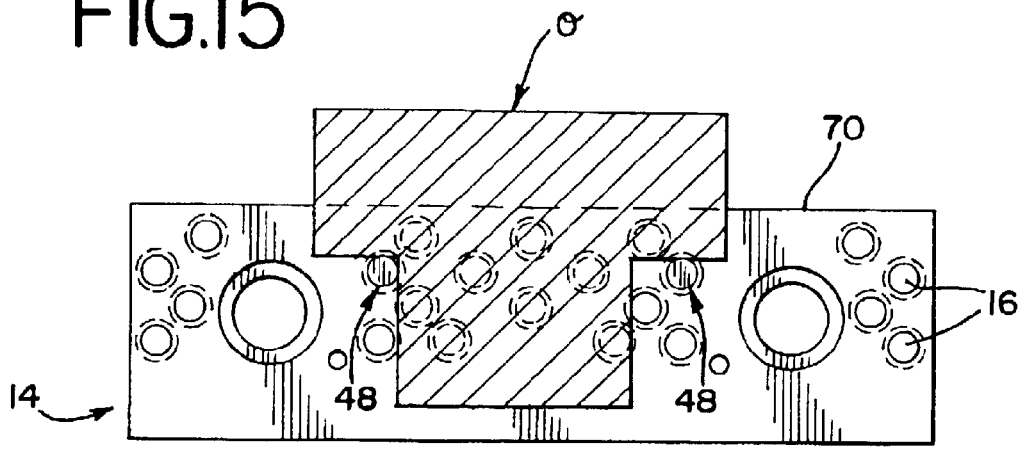
FIG. 15 is a plan view of a front surface of a block of the jaw assembly of FIG. 1 showing a t-shaped object supported by a support structure formed from a plurality of pins deployed to the use-position.

In FIG. 12, the support structure is formed from the three pins 48 under the lower edge of the object O that are deployed to the use position P2. In FIG. 13, the support structure is formed from the five pins 48 under the lower edge of the object O that are deployed to the use position P2. In FIG. 14, the support structure is formed from the two pins 48 under the lower edge of the object O that are deployed to the use position P2. In FIG. 15, the support structure is formed from the two pins 48 that are deployed to the use position P2.

Typically, two jaw assemblies 10 are installed in the vise 12, with one assembly 10 attached to the fixed member 22 and a second assembly attached to the moveable member 22. The operator deploys and retracts the pins 48 on one of the assemblies 10 and then proceeds to deploy and retract the pins 48 on the other assembly 10. As a result, a support structure is formed in both jaw assemblies 10 to support the object O. However, a support structure in only one jaw assembly 10 can be used to support an object O with dimensions smaller than the portion 50 of the pins 48. In this situation, the pins 48 in the other jaw assembly 10 remain in the non-use position P1 as the jaw assembly 10 engages and secures the object O while it is supported by the support structure.

After a support structure is formed in either one or both of the jaw assemblies 10, the object O is placed and supported on the pins 48 in an elevated position. When placed on the support structure formed from pins 48 in the use position P2, the object O can extend above or beyond the upper surface 70 of the block. Next, the moveable member 22 is displaced towards the fixed member 20 a distance until the members 20, 22 and assemblies 10 engage and secure the object. The displacement of the moveable member 22 can be controlled in a number of ways, including with the handle 26. Once the object is secured by the jaw assemblies 10, the object is ready for work to be performed on it. For example, the object can be drilled, finished, milled, buffed, cut, or ground once it is secured and supported by the jaw assemblies 10.

Referring to FIGS. 12 and 13, a pin 48*a* can be used as a restricting structure to prevent unwanted lateral movement or shifting of the object while it is being supported by pins 48 deployed to the use position P2. Because the pins 48 are independently deployable and retractable, the operator is not limited in selecting which pin 48*a* can be used to preclude movement of the object. Further securing the object with pin 48*a* can be especially beneficial when a tool is applied to the object that has a tendency to adversely displace or move the object. Typically, the pin 48*a* is located one row above the deployed pins 48 forming the support structure. Once the pins 48 are deployed to the use position P2, the operator of the jaw assembly 10 selectively retracts a plurality of pins 48 to form the support structure and the securing pin 48*a*. The operator of jaw assembly 10 can manually deploy the pin 48*a* forming the restricting structure with a magnet to prevent lateral movement of the object.

When supporting and securing an object O in an elevated position above the deck 28 and deck surface 29, the jaw assembly 10 functions in a manner similar to conventional parallels. However, the jaw assembly 10 has a number of significant distinctions and benefits when compared to conventional parallels. The jaw assembly 10 is single unit with independently adjustable pins 48 that form a support structure to secure and support an object in a multiple elevated positions above the deck 28. Once installed in the vise, the jaw assembly 10 is fixed and does not require additional or separate components to secure and support different-sized objects. In contrast, parallels have limited configurations that elevate the object in a single, fixed position. Sets of parallels can offer multiple positions, but only one parallel can be installed in the vise at a time, and the remaining parallels must be stored a distance from the vise. Accordingly, the operator must spend valuable time selecting and installing the appropriate parallel. With the jaw assembly 10, the time consuming process of selecting and installing different parallels is eliminated and the efficiency and the productivity of both the operator and the vise dramatically increase. The inability of the parallels to adjust to support the object reduces the efficiency of the parallels and increases the operating and equipment costs.

Figure 16:
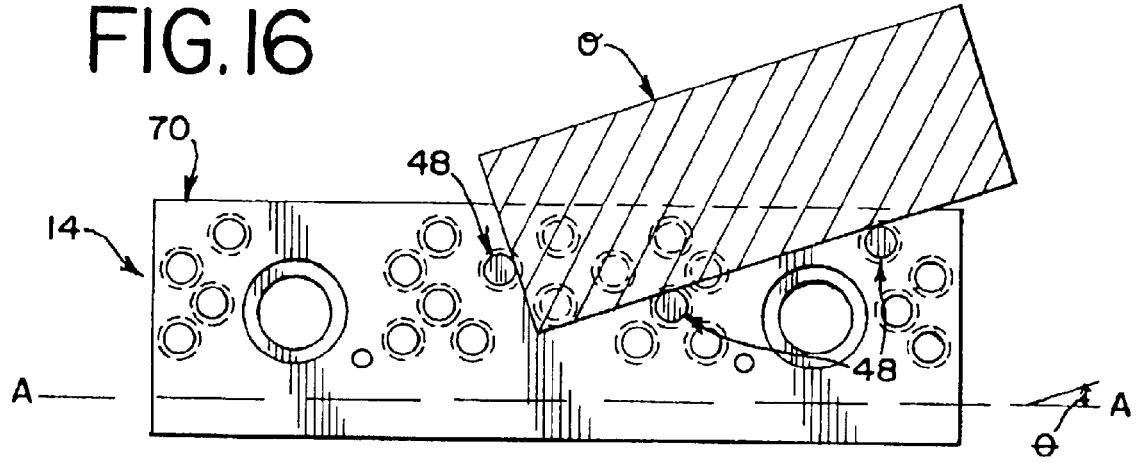
FIG. 16 is a plan view of a front surface of a block of the jaw assembly of FIG. 1 showing a rectangular object supported at a fifteen degree angle by a support structure formed from a plurality of pins deployed to the use-position.
Figure 17:
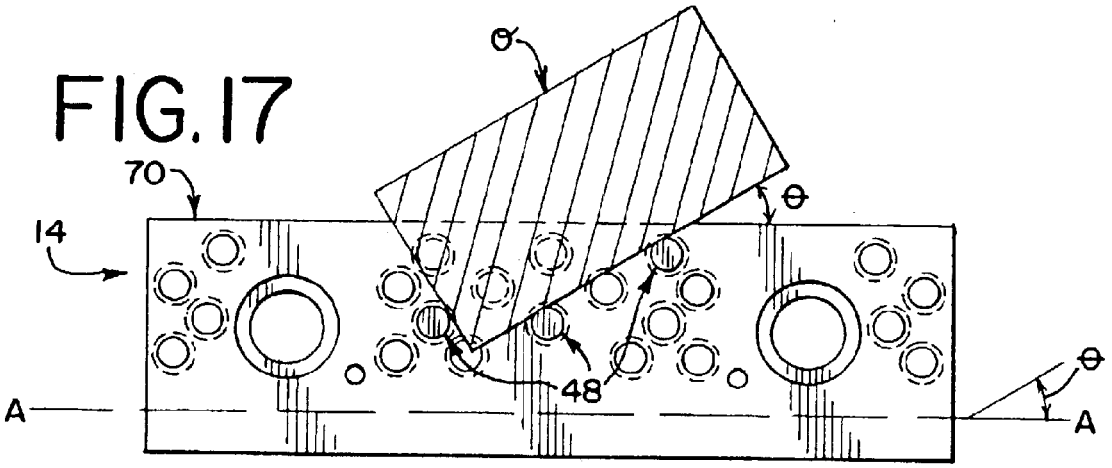
FIG. 17 is a plan view of a front surface of a block of the jaw assembly of FIG. 1 showing a rectangular object supported at a thirty degree angle by a support structure formed from a plurality of pins deployed to the use-position; and, FIG. 18 is a plan view of a front surface of a block of the jaw assembly of FIG. 1 showing a square object supported at a forty-five degree angle by a support structure formed from a plurality of pins deployed to the use-position.
Figure 18:
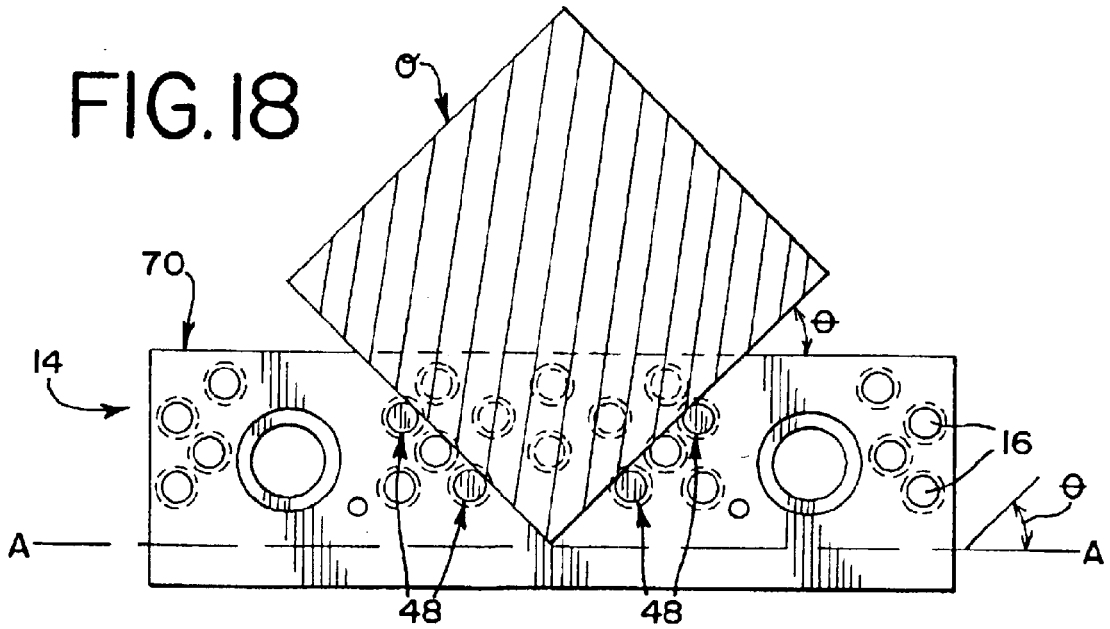

To support and secure an object in an elevated and angled position above the deck surface 28, a pin 48 or an arrangement of pins 48 must be deployed to the use position, P2. Referring to FIGS. 16–18, objects O with different configurations and dimensions can be supported in an elevated and angled position by an assortment of pins 48 deployed to the use position P2. Once the pins 48 are deployed to the use position P2, the operator of the jaw assembly 10 can selectively retract a pin 48 or a plurality of pins 48 to form the support structure. By deploying pins 48 and then retracting pins 48 or a plurality of pins 48, the operator can customize the support structure to match the shape and configuration of the object to be supported and secured at an angle θ by the jaw assembly 10. As shown in FIGS. 16–18, the angle θ is defined relative to a horizontal axis A of the block 14. The angle θ at which the object is supported can range between 0 and 90 degrees.

In FIGS. 16 and 17, the support structure is formed from the three pins 48 under the lower edge and side edge of the object O that are deployed to the use position P2. In FIG. 18, the support structure is formed from the four pins 48 under the side edges of the object O that are deployed to the use position P2.

Supporting and securing an object at an elevated and angled position enables the jaw assembly 10 to support and secure a wider variety of objects in the vise and increases the type of equipment that can be used or applied to the object. Accordingly, supporting and securing an object at an elevated and angled position increases the versatility and value of the jaw assembly 10 and eliminates the need for a set of individual mill angle jaws.

Unlike sets of parallels and mill angles, the jaw assembly 10 is not susceptible to problems caused by burrs and chips from the object worked upon. Once an object is worked upon, i.e. drilled, finished, or milled, burrs and chips from the object can accumulate on the deck 28 and deck surface 29. The accumulation of burrs and chips can be lodged under the parallels and mill angles, thereby hampering the removal of the parallels and the installation of other parallels and mill angles. Burrs, chips, and other debris cannot accumulate under the jaw assembly 10 because the lower edge 38 of the block 14 is juxtaposed above the deck 28.

Although the jaw assembly 10 is shown in a generally horizontal orientation in FIGS. 1–18, the jaw assembly 10 can be operated in a generally vertical orientation. This can occur when the vise 12 is integrated into a machine or manufacturing process and increases the utility and versatility of the jaw assembly 10. In this configuration, a portion of the object O can extend beyond the outer dimensions of the jaw assembly 10 and work can be more easily on the object O.

While particular embodiments of the invention have been shown and described, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

We claim:

1. A jaw assembly for use in a vise, comprising:

a block having a plurality of apertures, the block further having a plurality of channels passing through a rear surface of the block, each of the channels having an first segment in fluid connection with an inlet hole and having a second segment in fluid communication with at least one of the apertures; and, a plurality of pins, wherein each pin is located within an aperture and wherein each pin is deployable to a use position and retractable to a non-use position.

2. The jaw assembly of claim 1 wherein the channels extend in a generally longitudinal direction of the block.

3. The jaw assembly of claim 1 having at least one fluid passageway, the passageway extending from the inlet hole to at least one aperture.

4. The jaw assembly of claim 1 including a plate secured to the rear surface of the block to enclose the channels.

5. The jaw assembly of claim 4 including a means for securing the plate to the block.

6. The jaw assembly of claim 5 including a means for fixedly attaching the block and plate to the vise.

7. The jaw assembly of claim 3 wherein the apertures have a first and second aperture portion, the first aperture portion having a diameter less than a diameter of the second aperture portion such that a ledge is formed between the first and second aperture portions, each pin having a stop, the engagement of the ledge and the stop preventing further deployment of the pin.

8. The jaw assembly of claim 3 wherein the apertures have a first and second hole portion, the first hole portion having a diameter less than a diameter of the second hole portion forming a ledge between the first and second hole portions, each pin having a first and second pin portion, the firs pin portion having a diameter less than a diameter of the second pin portion, the engagement of the ledge and the second pin portion preventing movement of the second pin portion into the first hole portion.

9. A jaw assembly for use in supporting and securing an object in a vise, comprising:

a block having a plurality of apertures, the block further having a plurality of channels in a rear surface of the block, each of the channels having a first segment in fluid connection with an inlet hole and having a second segment in fluid communication with at least one of the apertures;

a plate secured to the rear surface of the block, the plate adapted to enclose the channels; and, a plurality of pins, wherein each pin is located within an aperture and is in slidable engagement with the particular aperture.

10. The jaw assembly of claim 9 having at least one fluid passageway, the passageway extending from the inlet hole to at least one aperture.

11. The jaw assembly of claim 9 wherein pins within apertures of a common channel are concurrently deployable to a use position and independently retractable to a non-use position.

12. The jaw assembly of claim 11 wherein the pins, when deployed to the use position, form a support structure that supports the object at an angle relative to a horizontal axis of the block.

13. The jaw assembly of claim 12 wherein the angle ranges between 0 to 90 degrees.

14. The jaw assembly of claim 12 wherein the angle is 15 degrees.

15. The jaw assembly of claim 12 wherein the angle is 30 degrees.

16. The jaw assembly of claim 12 wherein the angle is 45 degrees.

17. The jaw assembly of claim 11 including means for securing the plate to the block.

18. The jaw assembly of claim 17 including a means for fixedly attaching the plate and the block to the vise.

19. The jaw assembly of claim 11 wherein the apertures have a first and second aperture portion, the first aperture portion having a diameter less than a diameter of the second aperture portion such that a ledge is formed between the first and second aperture portions, each pin having a stop, the engagement of the ledge and the stop preventing further deployment of the pin.

20. The jaw assembly of claim 11 wherein the apertures have a first and second hole portion, the first hole portion having a diameter less than a diameter of the second hole portion forming a ledge between the first and second hole portions, each pin having a first and second pin portion, the first pin portion having a diameter less than a diameter of the second pin portion, the engagement of the ledge and the second pin portion preventing movement of the second pin portion into the first hole portion.

21. A jaw assembly for use in supporting and securing an object in a vise, comprising:

a block having a plurality of apertures, wherein each aperture is spaced a distance from a lower edge of the block, the block further having a first and second channel passing through a portion of the block, each of the channels having a first segment and second segment, the first segments in fluid connection with a first in let hole and the second segments in fluid communication with at least one of the apertures, the block further having a third and fourth channel passing through a portion of the block, each of the channels having a first segment and second segment the first segments in fluid connection with a second inlet hole and the second segments in fluid communication with at least one of the apertures;

a plurality of pins, wherein each pin is located within an aperture and each pin is deployable to a use position and retractable to a non-use position.

22. The jaw assembly of claim 21 having at least one fluid passageway, the passageway extending from the inlet hole to at least one aperture.

23. The jaw assembly of claim 21 wherein the channels are in a rear surface of the block.

24. The jaw assembly of claim 23 including a plate secured to the rear surface of the block, the plate adapted to enclose the channels.

25. The jaw assembly of claim 24 including a means for securing the plate to the block.

26. The jaw assembly of claim 25 including a means for fixedly attaching the block and plate to the vise.

27. The jaw assembly of claim 22 wherein the apertures have a first and second aperture portion, the first aperture portion having a diameter less than a diameter of the second aperture portion such that a ledge is formed between the first and second aperture portions, each pin having a stop, the engagement of the ledge and the stop preventing further deployment of the pin.

28. The jaw assembly of claim 22 wherein the apertures have a first and second hole portion, the first hole portion having a diameter less than a diameter, of the second hole portion forming a ledge between the first and second hole portions, each pin having a first and second pin portion, the first pin portion having a diameter less than a diameter of the second pin portion, the engagement of the ledge and the second pin portion preventing movement of the second pin portion into the first portion.

29. The jaw assembly of claim 22 wherein the pins within apertures of a common channel are concurrently deployable to a use position and independently retractable to a non-use position.

30. The jaw assembly of claim 22 wherein the pins, when deployed to the use position, form a support structure that supports the object in an elevated position above the lower edge of the block.

31. A jaw assembly for use in supporting and securing an object in a vise, comprising:

a block having a plurality of apertures, wherein each aperture is spaced a distance from a lower edge of the block, the block further having a first and second channel passing through a rear surface of the block, each of the channels having a first segment and second segment, the first segments in fluid connection with a first inlet hole and the second segments in fluid communication with at least one of the apertures, the block further having a third and fourth channel passing through the rear surface of the block, each of the channels having a first segment and second segment, the first segments in fluid connection with a second inlet hole and the second segments in fluid communication with at least one of the apertures;

a plate secured to the rear surface of the block, the plate adapted to enclose the channels; and, a plurality of pins, wherein each pin is located within an aperture and each pin is deployable to a use position and retractable to a non-use position.

32. The jaw assembly of claim 31 having at least one fluid passageway, the passageway extending from the inlet hole to at least one aperture.

33. The jaw assembly of claim 32 including a means for securing the plate to the block.

34. The jaw assembly of claim 33 including a means for fixedly attaching the block and plate to the vise.

35. The jaw assembly of claim 32 wherein the apertures have a first and second aperture portion, the first aperture portion having a diameter less than a diameter of the second aperture portion such that a ledge is formed between the first and second aperture portions, each pin having a stop, the engagement of the ledge and the stop preventing further deployment of the pin.

36. The jaw assembly of claim 32 wherein the apertures have a first and second hole portion, the first hole portion having a diameter less than a diameter of the second hole portion forming a ledge between the first and second hole portions, each pin having a first and second pin portion, the first pin portion having a diameter less than a diameter of the second pin portion, the engagement of the ledge and the second pin portion preventing movement of the second pin portion into the first hole portion.

37. The jaw assembly of claim 32 wherein the pins, when deployed to the use position, form a support structure that supports the object in an elevated position above a deck surface of the vise and at an angle relative to a horizontal axis of the block.

38. The jaw assembly of claim 32 wherein the angle ranges between 0 and 90 degrees.

39. The jaw assembly of claim 32 wherein the pins, when deployed to the use position, form a support structure that supports the object in an elevated position above the lower edge of the block and at an angle relative to a horizontal axis of the block.

40. The jaw assembly of claim 39 wherein the angle ranges between 0 and 90 degrees.

41. A jaw assembly for use in a vise, the jaw assembly permitting an object to be worked on to be secured and supported at an elevated position, the assembly comprising:

a block having a first set, a second set, and a third set of apertures spaced a distance from the deck surface, the block further having a first, a second, and a third longitudinal channel passing through a portion of the block, each of the channels having a first segment in fluid connection with an inlet hole and a second segment in fluid communication with at least one of the apertures;

a plurality of pins, wherein each pin is located within an aperture and wherein each yin is deployable to a use position and retractable to a non-use position; and wherein the first set of apertures intersect the first channel to define a first fluid passageway, the second set of apertures intersect the second channel to define a second fluid passageway, and the third set of apertures intersect the third channel to define a third fluid passageway.

42. The jaw assembly of claim 41, wherein the pins, when deployed to the use position, form a support structure that supports the object in elevated position.

43. The jaw assembly of claim wherein the channels are in a rear surface of the block.

44. The jaw assembly of claim 43 including a plate secured to the rear surface of the block, the plate adapted to enclose the channels.

45. The jaw assembly of claim 44 including a means for securing the plate to the block.

46. The jaw assembly of claim 44 including a means for fixedly attaching the block and plate to the vise.

47. The jaw assembly of claim 42 wherein each aperture of the first set, second set, and third set of apertures has a first and second aperture portion, the first aperture portion having a diameter less than a diameter of the second aperture portion such that a ledge is formed between the first and second aperture portions, each pin having a stop, the engagement of the ledge and the stop preventing further deployment of the pin.

48. The jaw assembly of claim 42 wherein each aperture of the first set, second set, and third set of apertures has a first and second hole portion, the first hole portion having a diameter less than a diameter of the second hole portion forming a ledge between the first and second hole portions, each pin having a first and second pin portion, the first pin portion having a diameter less than a diameter of the second pin portion, the engagement of the ledge and the second pin portion preventing movement of the second pin portion into the first hole portion.

49. A jaw assembly for use in a vise, comprising:

a block having a plurality of apertures, the block further having a first inlet hole in fluid connection with at least one channel passing through a rear surface of the block, the channel having a portion in fluid communication with at least one of the apertures, the block further having a second inlet hole in fluid connection with at least one channel passing through a rear surface of the block, the channel having a portion in fluid communication with at least one of the apertures;

a plate secured to the rear surface of the block, the plate adapted to enclose the channels; and, a plurality of pins, wherein each pin is located within an aperture and wherein each pin is deployable to a use position and retractable to a non-use position.

* * * * *